US009470048B1

(12) United States Patent
Smith et al.

(10) Patent No.: US 9,470,048 B1
(45) **Date of Patent: *Oct. 18, 2016**

(54) BIDIRECTIONAL STABILIZER WITH IMPACT ARRESTORS

(71) Applicant: ALASKAN ENERGY RESOURCES, INC., Anchorage, AK (US)

(72) Inventors: Lee Morgan Smith, Anchorage, AK (US); Betty A. Eastup-Smith, Anchorage, AK (US)

(73) Assignee: ALASKAN ENERGY RESOURCES, INC., Anchorage, AK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/981,376

(22) Filed: Dec. 28, 2015

Related U.S. Application Data

(63) Continuation-in-part of application No. 14/802,104, filed on Jul. 17, 2015, now Pat. No. 9,297,209.

(60) Provisional application No. 62/069,456, filed on Oct. 28, 2014.

(51) Int. Cl.

| | |
|---|---|
| ***E21B 17/22*** | (2006.01) |
| ***E21B 7/28*** | (2006.01) |
| ***E21B 3/02*** | (2006.01) |
| ***E21B 10/46*** | (2006.01) |
| ***E21B 17/10*** | (2006.01) |
| ***E21B 10/26*** | (2006.01) |

(52) U.S. Cl.
CPC ..... *E21B 17/22* (2013.01); *E21B 3/02* (2013.01); *E21B 7/28* (2013.01); *E21B 10/26* (2013.01); *E21B 10/46* (2013.01); *E21B 17/1078* (2013.01)

(58) Field of Classification Search
CPC .... E21B 10/26; E21B 10/30; E21B 17/1078; E21B 17/22
See application file for complete search history.

(56) References Cited

U.S. PATENT DOCUMENTS

| | | | | |
|---|---|---|---|---|
| RE19,339 | E | 10/1934 | Vertson | |
| 3,268,274 | A * | 8/1966 | Ortloff | E21B 17/1078 175/325.4 |
| 3,285,678 | A | 11/1966 | Garrett et al. | |
| 3,322,217 | A | 5/1967 | Cook | |
| 3,420,323 | A | 1/1969 | Owens | |
| 4,081,203 | A | 3/1978 | Fuller | |
| 4,231,437 | A | 11/1980 | Swersky et al. | |
| 4,277,869 | A | 7/1981 | Hartwell | |
| 4,385,669 | A | 5/1983 | Knutsen | |
| 4,610,316 | A | 9/1986 | Boaz | |

(Continued)

FOREIGN PATENT DOCUMENTS

WO 2013167954 A1 11/2013

*Primary Examiner* — Shane Bomar
(74) *Attorney, Agent, or Firm* — Buskop Law Group, PC; Wendy Buskop

(57) ABSTRACT

A bidirectional stabilizer which reduces impact damage while rotating into and out of a wellbore. The bidirectional stabilizer can be coupled on a first end to a drill string and on a second end to a drill bit. The bidirectional stabilizer can have an annulus configured for maximum wellbore fluid flow. A cutting portion can be formed on a shaft with a plurality of helical blades between the first shaft end and the second shaft end. The plurality of helical blades of the cutting portion can be on a first plane and a plurality of cutting nodes can be on a second plane for smoothing a wellbore. The plurality of cutting nodes can have at least one impact arrestor mounted directly adjacent each cutting node.

20 Claims, 3 Drawing Sheets

(56) References Cited

U.S. PATENT DOCUMENTS

| | | | | |
|---|---|---|---|---|
| 4,664,206 | A | 5/1987 | Butler | |
| 5,330,016 | A | 7/1994 | Paske | |
| 6,695,080 | B2 * | 2/2004 | Presley | E21B 10/16 175/391 |
| 7,650,952 | B2 | 1/2010 | Evans et al. | |
| 8,162,081 | B2 | 4/2012 | Ballard et al. | |
| 8,607,900 | B1 | 12/2013 | Smith | |
| 9,145,746 | B1 | 9/2015 | Smith | |
| 9,151,118 | B2 | 10/2015 | Robson | |
| 9,151,119 | B1 | 10/2015 | Smith | |
| 2010/0051349 | A1 | 3/2010 | Ballard | |
| 2011/0253457 | A1 | 10/2011 | Shen | |
| 2012/0255786 | A1 | 10/2012 | Isenhour | |
| 2014/0202770 | A1 | 7/2014 | Zaki et al. | |
| 2014/0246247 | A1 | 9/2014 | Smith | |
| 2015/0275589 | A1 * | 10/2015 | Walker | E21B 17/1078 175/40 |

* cited by examiner

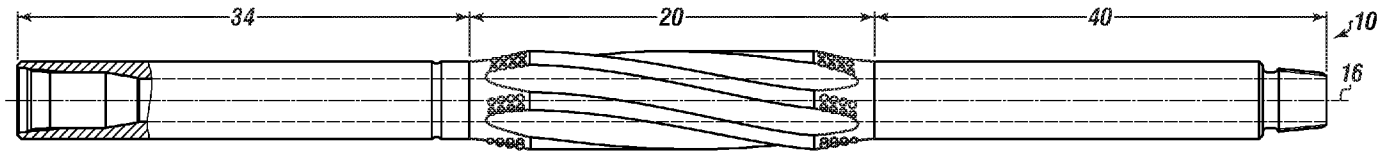
FIGURE 1
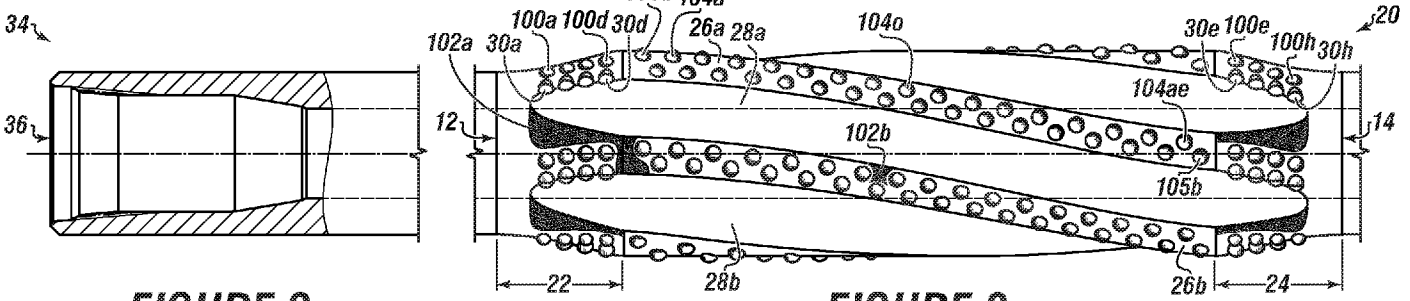
FIGURE 2
FIGURE 3
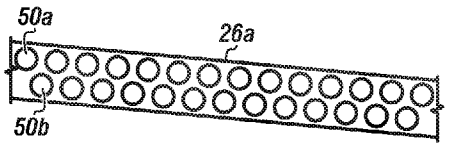
FIGURE 5
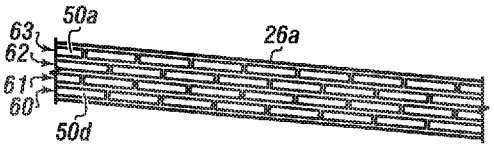
FIGURE 6
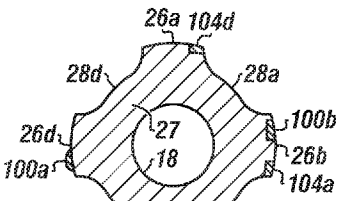
FIGURE 4

BIDIRECTIONAL STABILIZER WITH IMPACT ARRESTORS

CROSS REFERENCE TO RELATED APPLICATION

The current application is a Continuation in Part of co-pending U.S. Utility patent application Ser. No. 14/802,104 filed on Jul. 17, 2015, entitled "BIDIRECTIONAL STABILIZER," which claims priority to and the benefit of U.S. Provisional Patent Application Ser. No. 62/069,456 filed on Oct. 28, 2014, entitled "BIDIRECTIONAL STABILIZER". These references are hereby incorporated in their entirety.

FIELD

The present embodiments generally relates to a bidirectional stabilizer with impact arrestors. The present embodiments further relate to a drilling rig having a bidirectional stabilizer for use in a wellbore, wherein the bidirectional stabilizer is coupled on a first end to a drill string and on a second end to a drill bit.

BACKGROUND

A need exists for a bidirectional stabilizer for a drill string that can additionally smooth and improve quality of a wellbore bidirectionally.

A need exists for a drilling rig with bidirectional stabilizer with impact arrestors and additional cutting elements.

The present embodiments meet these needs.

BRIEF DESCRIPTION OF THE DRAWINGS

The detailed description will be better understood in conjunction with the accompanying drawings as follows:

FIG. 1 depicts a side view of a bidirectional stabilizer according to one or more embodiments.

FIG. 2 depicts an end portion of the bidirectional stabilizer according to one or more embodiments.

FIG. 3 depicts a cutting portion of the bidirectional stabilizer according to one or more embodiments.

FIG. 4 depicts a cut view of the cutting portion according to one or more embodiments.

FIG. 5 depicts a detailed view of a surface of a blade according to one or more embodiments.

FIG. 6 depicts a detailed view of a surface of a blade according to one or more embodiments.

Figure 7:
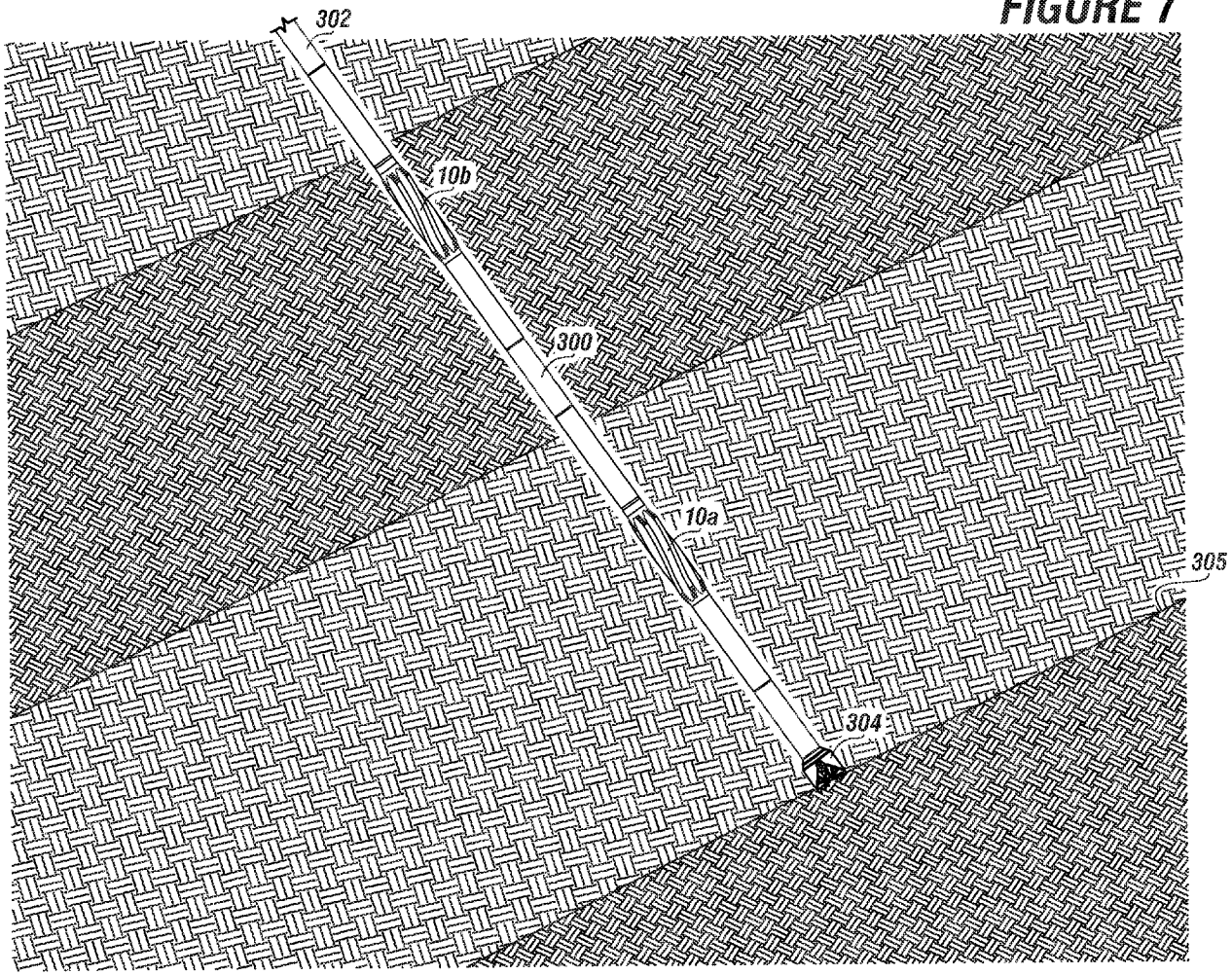
FIG. 7 shows a downhole drill string in the wellbore according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments generally relates to a bidirectional stabilizer with impact arrestors, optional cutting elements and optional cutting buttons.

The present embodiments further relate to a drilling rig having a bidirectional stabilizer with impact arrestors for use in a wellbore, wherein the bidirectional stabilizer can be coupled on a first end to a drill string and on a second end to a drill bit.

The present embodiments relate to a drill string having one or more bidirectional stabilizers with impact arrestors for use in a wellbore. The bidirectional stabilizer can be coupled on a first end to a drill string and on a second end to a drill bit.

The bidirectional stabilizer reduces impact damage while rotating into and out of a wellbore.

The bidirectional stabilizer can have an annulus configured for maximum wellbore fluid flow.

The bidirectional stabilizer can have a cutting portion can be formed on a shaft with a plurality of helical blades between the first shaft end and the second shaft end.

The plurality of helical blades of the cutting portion can be on a first plane.

The bidirectional stabilizer can have a plurality of cutting nodes can be on a second plane for smoothing a wellbore.

A plurality of impact arrestors can be used, each impact arrestor can be mounted directly adjacent each cutting node.

In embodiments, impact arrestors are mounted at a right angle to a longitudinal axis of the bidirectional stabilizer.

In embodiments, the impact arrestors reduce torque variation, provide consistent depth of cut, and limit deviation tendencies, which prevents damage to the drill bit or bottom hole assembly during bit drilling.

The embodiments further relate to a drilling rig with a bidirectional stabilizer that stabilizes a drill string while the drill rig rotates drill pipe into and out of a wellbore.

The embodiments relate to a drill string with at least one bidirectional stabilizer secured thereto. In embodiments, the drill string can support up to 3 bidirectional stabilizers per drill string and can engage bottom hole assemblies or drill bits.

Each bidirectional stabilizer used by the drilling rig or the drill string can additionally increase a wellbore diameter and improve the quality of the wellbore while simultaneously stabilizing a drill string secured to a drilling rig and ensures a longer life to the tools connected to the drill string.

The bidirectional stabilizer can be coupled on a first shaft end to the drill string and on a second shaft end to a bottom hole assembly or other downhole equipment.

The bidirectional stabilizer can have an annulus configured for maximum wellbore fluid flow.

The bidirectional stabilizer cutting portion can be formed on a shaft with a plurality of helical blades between the first and second shaft ends. The plurality of helical blades of the cutting portion can be on a first plane and a plurality of cutting nodes can be on a second plane, such as from 10 degrees to 30 degrees from the longitudinal axis of the bidirectional stabilizer.

In embodiments, at least one impact arrestor can be mounted in a location either directly adjacent each cutting node on the first cutting portion, directly adjacent each cutting node on the second cutting portion or both locations.

The impact arrestor can be used to avoid sudden torque spikes due to sudden changes in weight on bit.

The term "diamond impregnated" as used herein can refer to a metal matrix with synthetic diamond particles and/or natural diamond particles embedded in the metal matrix.

The term "polycrystalline diamond" as used herein can refer to a multilayer component with a first layer of synthetic diamond material and a second layer of a tungsten carbide substrate.

In embodiments, two bidirectional stabilizers can be used on the same drill string, each with a different configuration, such as one bidirectional stabilizer can have 40 cutting nodes and the other bidirectional stabilizer can have 60 cutting nodes.

The embodiments can improve safety at the wellsite by reducing the number of trips into a well to solve the problem of drift in the diameter of the wellbore.

The embodiments simultaneously provide a stable drill string while enabling reaming of a wellbore, which can protect the environment by reducing the number of trips by a bottom hole assembly out of a wellbore.

The embodiments can also minimize the possibility that wellbore fluid and other material from drilling a wellbore can explode out of a wellbore by minimizing the number of trips from the wellbore.

The embodiments enable a wellbore that cannot be smoothed out, which in turn can prevent damage to packers being sent down the wellbore.

The bidirectional stabilizer can connect to a drill string, connect to a bit coupled to the drill string and/or connect to a bottom hole assembly coupled to the drill string. The bidirectional stabilizer can be coupled to the drill string between the bottom hole assembly and tubulars that make up the drill string.

In embodiments, the bidirectional stabilizer can have an outer diameter from a 26 inches outer diameter to a 3 inches outer diameter.

The bidirectional stabilizer can have a cutting portion with a plurality of helical blades extending radially from the shaft.

The cutting portion can have a plurality of cutting inserts installed adjacent a plurality of cutting nodes. In embodiments, the plurality of cutting inserts can be tungsten carbide inserts, or other suitable materials used for drilling wellbores.

In embodiments, the plurality of cutting inserts can be in the shape of circles, cylinders, rectangles, ellipses, or other suitable shapes as required by a specific application.

In embodiments, the bidirectional stabilizer can have impact arrestors.

Impact arrestors can be mounted on either the first cutting portion, the second cutting portion or both the first cutting portion and the second cutting portion to provide cutting when the cutting nodes wear down and impact control when the bidirectional stabilizer contacts to the wellbore.

Each impact arrestor can be made of at least one of: a tungsten carbide impact arrestor, a ceramic impact arrestor, a polycrystalline diamond impact arrestor or a diamond impregnated impact arrestor.

A plurality of cutting elements can also be used on the bidirectional stabilizer. Each cutting element can be a diamond impregnated cutting element or a polycrystalline diamond cutting element. Both types can be used on the bidirectional stabilizer. The plurality of cutting elements can be mounted either directly on a face of the helical blades or directly on at least one edge of the helical blades.

The bidirectional stabilizer can have a diamond enhanced hardfacing disposed on least one of: a portion of each helical blade, each entire helical blade, and an area surrounding each impact arrestor.

Each of the impact arrestors can have in any geometrical shape.

In embodiments, from 1 impact arrestor to 60 impact arrestors can be used per bidirectional stabilizer. Each impact arrestor can be configured to simultaneously perform as a shock dampener and as a cutting element.

Each impact arrestor can be either flush mounted in one or both cutting portions or mounted to be slightly raised above a surface of the cutting portion.

Each cutting element can be mounted to be slightly raised above a surface of the cutting portion but less than the height of the impact arrestor.

In embodiments, each cutting element can be mounted to a helical blade. The cutting elements can be flush mounted or extend from the surface of the blade.

In embodiments, the bidirectional stabilizer can include cutting buttons mounted on at least one of: an edge of each helical blade, cutting portions adjacent cutting nodes, and a surface of each helical blade.

In embodiments, the cutting buttons can be aligned with a cutting node, an impact arrestor, a cutting element, other cutting buttons, or combinations thereof.

The cutting buttons can be cylindrical in shape or of another shape, and can extend away from the surface of the helical blades, from the surface of the cutting portions or from both if the cutting buttons are used on both surfaces.

In embodiments, the cutting buttons can have a rigid surface, such as an edge of a quarter or a rough surface.

The cutting buttons can be made of a different material than the cutting nodes. In embodiments, the cutting elements and the impact arrestors give versatility to the bidirectional stabilizer increasing its ability to operate in many different types of rock with different hardness that may be encountered during drilling.

The impact arrestors protect cutting nodes of polycrystalline diamond compacts by performing as shock disseminators.

Diamond enhanced hardfacing of any geometrical shape can be applied to the helical blades and to the cutting portions of the bidirectional stabilizer.

The diamond enhanced hardfacing can be applied in between cutting elements, impact arrestors, and the cutting buttons, and can disposed across each helical blade continuously or in blocks in between helical blades.

Impact arrestors can be installed on the bidirectional stabilizer at an angle ranging from 30 degrees to 90 degrees from a longitudinal axis of the bidirectional stabilizer.

Cutting elements can be installed on the bidirectional stabilizer at an angle ranging from 30 degrees to 90 degrees from a longitudinal axis of the bidirectional stabilizer.

Cutting buttons can be installed on the bidirectional stabilizer at an angle ranging from 30 degrees to 90 degrees from a longitudinal axis of the bidirectional stabilizer.

In embodiments, a first portion of the impact arrestors can be oriented at a different angle from a second portion of the impact arrestors on the same tool.

In embodiments, a first portion of the cutting elements can be oriented at a different angle from a second portion of cutting elements on the same tool.

In embodiments, a first portion of the cutting buttons can be oriented at a different angle from a second portion of cutting buttons on the same tool.

The bidirectional stabilizer has a symmetrical configuration.

Turning now to the Figures, FIG. 1 depicts a side view of a bidirectional stabilizer according to one or more embodiments.

The bidirectional stabilizer 10 can include a shaft with a longitudinal axis 16. The longitudinal axis can be the axis of rotation of the shaft. The bidirectional stabilizer can be a centric bidirectional stabilizer that allows the axis of rotation of the shaft to be the same as the center of axis of rotation for the drill pipe or tubulars forming a drill string.

In embodiments, the bidirectional stabilizer can be modular.

In embodiments, the bidirectional stabilizer can be made from either steel or a non-magnetic material.

The bidirectional stabilizer can have a nose portion 40, an end portion 34 and a cutting portion 20. The end portion 34 can have a stab end for receiving a stab from the drill string. The nose portion 40 can engage a bottom hole assembly, another drill pipe or tubular of a drill string, a drill bit, measurement while drilling equipment, or rotary steering downhole drilling motors.

In embodiments, the nose portion 40 can have an outer diameter ranging from 3 inches to 36 inches and an inner diameter that can be identical or substantially equivalent to the end portion. The inner diameter can be from 1 inch to 3 inches.

In other embodiments, the nose portion and the end portion can have the same inner diameters for flow through of wellbore fluid.

In embodiments, the cutting portion 20 can have an outer diameter that can be from 1 percent to 25 percent larger in diameter than the outer diameter of the nose portion or the outer diameter of the end portion.

In embodiments, the outer diameter of the cutting portion 20 can be in a plane different from the outer diameter of the nose portion 40 or the outer diameter of the end portion 34.

The cutting portion 20 can be between the nose portion 40 and the end portion 34.

FIG. 2 depicts an end portion of the bidirectional stabilizer according to one or more embodiments.

The end portion 34 can have a stab end 36, which can be configured to receive components from the bottom hole assembly, such as a collar or the like, made of nickel alloys, primarily composed of nickel and copper, with small amounts of iron, manganese, carbon, and silicon or a MONEL® collar.

FIG. 3 depicts a cutting portion of the bidirectional stabilizer according to one or more embodiments.

The cutting portion 20 can have a first shaft end 12 and a second shaft end 14. In embodiments, the first and second shaft ends can be threaded.

An annulus can be formed longitudinally through the first shaft end and the second shaft end. The annulus can be configured for maximum wellbore fluid flow.

A first cutting portion 22 can extend at a first angle from the first shaft end 12. The first angle can range from 10 degrees to 30 degrees from the longitudinal axis, forming a slightly larger outer diameter for the first cutting portion as the first cutting portion extends away from the first shaft end 12.

A second cutting portion 24 can extend at a second angle from the second shaft end 14. The second angle can range from 10 degrees to 30 degrees from the longitudinal axis forming a slightly larger outer diameter for the second cutting portion as the second cutting portion extends away from the second shaft end 14.

A plurality of impact arrestors 100*a*-100*d* are shown on the first cutting portion 22 and a plurality of impact arrestors 100*e*-100*h* are shown on the second cutting portion 24.

In embodiments, the plurality of impact arrestors can be mounted directly adjacent a cutting node on the first cutting portion, the second cutting portion or both the first cutting portion and the second cutting portion.

A plurality of cutting nodes 30*a*-30*d* are shown on the first cutting portion 22 and a plurality of cutting nodes 30*e*-30*h* are shown on the second cutting portion 24.

The plurality of cutting nodes can have a diameter ranging from ⅜ of an inch to 1 inch. In embodiment, the plurality of cutting nodes can extend from 0.1 inch to 0.5 inches from the surface of the first and second cutting portions. In embodiments, the plurality of cutting nodes can be polycrystalline diamond compacts or other suitable materials used for drilling wellbores.

A plurality of helical blades 26*a* and 26*b* can extend identically from the first shaft end, the second shaft end, or both in a flat plane for enhanced stability of the drill string, reducing wobble.

In embodiments, the plurality of helical blades can be longitudinally connected between the first and second cutting portions in a plane parallel to the longitudinal axis.

In embodiments, a plurality of cutting elements 104*a*-104*ae* can be on the plurality of helical blades 26*a* and 26*b*.

In embodiments, a plurality of cutting buttons 105*a* and 105*b* can be mounted on a surface of the helical blades. In embodiments, the plurality of cutting buttons can be mounted on an edge of each helical blade, cutting portions adjacent the plurality of cutting nodes, a surface of each helical blade, or combinations thereof.

In embodiments, a plurality of flutes 28*a* and 28*b* can be used, wherein each flute of the plurality of flutes can be formed between each pair of helical blades of the plurality of helical blades. Each flute of the plurality of flutes can be tapered on each end. The depth of each flute of the plurality of flutes can be from 10 percent to 50 percent of the outer diameter of the overall bidirectional stabilizer.

For example, for a 6 inch outer diameter bidirectional stabilizer, the trough or flute of the plurality of flutes can range in depth from 4 and ⅞ inches to 6 inches.

For this type of drilling application, all of the drilling components can be made up with a high strength or "premium" connection. The bidirectional stabilizer can use a unique flute depth while still providing a strong high strength premium connection, for example, this bidirectional stabilizer can provide an XT 39, 4 and ½ inch connection.

The flute depth can be as deep as possible to ensure a maximum flow of drill cuttings without clogging, while simultaneously providing a high strength premium connection.

Flute 28*a* can be formed between a pair of helical blades 26*a* and 26*b* and flute 28*b* can be formed between a different pair of helical.

In embodiments, at least one diamond enhanced hardfacing 102*a* and 102*b* can be disposed on at least a portion of one of the plurality of helical blades. In embodiments, the diamond enhanced hardfacing can be disposed on each of the helical blades. The diamond enhanced hardfacing can completely cover each blade, or in other embodiments, the diamond enhanced hardfacing can cover portions of the helical blades. In still additional embodiments, the hardfacing can be arranged in patterns, such as helical patterns to more quickly cut the wellbore in the direction the bidirectional stabilizer is being rotated.

FIG. 4 depicts a cut view of the cutting portion according to one or more embodiments.

In this embodiment, the plurality of helical blades 26*a*-26*d* are shown. The plurality of helical blades can be formed on the outer surface of a shaft 27. An annulus 18 is also shown.

In embodiments, when helical blades are used, the helical blades can have identical sizes. In embodiments, the helical blades can have different thicknesses.

In embodiments, the bidirectional stabilizer does not need any helical blades to operate.

The plurality of flutes 28*a*-28*d* can be located between pairs of helical blades of the plurality of helical blades 26*a*-26*d*.

As measured from the outer surface of the shaft 27, each helical blade of the plurality of helical blades can have an identical thickness for this concentric bidirectional stabilizer.

In embodiments, the plurality of impact arrestors 100*a* and 100*b* can be used. Impact arrestor 100*a* is shown extending from the surface of the helical blade. Impact arrestor 100*b* is shown embedded in the helical blade in a flush fit, which can form a smooth surface with the helical blade.

In embodiments, the plurality of cutting elements 104*a* and 104*d* can be installed on the edge of the helical blade.

In embodiments, the plurality of cutting buttons 105*c* can be mounted on an edge of the helical blade.

In embodiments, from 1 impact arrestor to 60 impact arrestors can be used. In embodiments, each impact arrestor can be configured to simultaneously perform as a shock dampener and as a cutting element.

In embodiments, from 1 cutting element to 60 cutting elements can be used. In embodiments, from 1 cutting button to 60 cutting buttons can be used.

In this Figure, the impact arrestor 100*a* is shown flush mounted in the cutting portion and the impact arrestor 104*b* is shown slightly raised above a surface of the cutting portion. It should be noted that the raised impact arrestors can have a height less than a height of the cutting nodes.

In embodiments, each impact arrestor can be cylindrical in shape and identical to the diameter of the cutting nodes. In embodiments, each impact arrestor can extend from the surface less than the cutting nodes, such as 10 percent less than the adjacent cutting nodes.

FIG. 5 depicts a detailed view of a surface of a helical blade of the plurality of helical blades according to one or more embodiments.

In embodiments, the blade of the plurality of helical blades 26*a* can have a plurality of cutting inserts 50*a* and 50*b* disposed thereon. The plurality of cutting inserts can be circular in shape.

In embodiments, the plurality of cutting inserts can be arranged on the blade of the plurality of helical blades in an alternating arrangement. While the plurality of cutting inserts are shown as circular, other embodiments can make use of any suitable shape for the plurality of cutting inserts.

The plurality of cutting inserts can range in diameter, if circular from ⅛ inch to 1 inch. In embodiments, up to 150 cutting inserts can be installed on the blade of the plurality of helical blades.

A portion of the plurality of cutting inserts can be installed adjacent the plurality of cutting nodes at the ends of the helical blades of the plurality of helical blades.

In other embodiments, the plurality of cutting inserts can range from 15 cutting inserts per inch to 50 cutting inserts per inch.

The plurality of cutting inserts can be rectangular in shape and arranged in an alternating configuration on the blade of the plurality of helical blades.

FIG. 6 depicts a detailed view of a surface of a blade of the plurality of helical blades according to one or more embodiments.

The blade of the plurality of helical blades 26*a* can have a plurality of cutting inserts 50*a* and 50*d* disposed thereon. The plurality of cutting inserts can be rectangular in shape and configured in an alternating arrangement.

The plurality of cutting inserts can be arranged in parallel rows 60, 61, 62 and 63 with a first row 60 offset from a second row 61.

In embodiments, the plurality of cutting inserts can have a shape other than a circular shape, such as a rectangular shape, and be arranged in an alternating configuration on the blade of the plurality of helical blades.

In embodiments, the plurality of cutting inserts can be installed on at least one edge of at least one blade of the plurality of helical blades. In embodiments, at least one cutting insert to 30 cutting inserts can be used per blade.

In embodiments, the bidirectional stabilizer excluding the plurality of cutting nodes can be an integral one piece bidirectional stabilizer formed from a single piece of metal.

In embodiments, the plurality of helical blades can be formed from a material harder than the material used to form the first shaft end, the shaft and the second shaft end.

In embodiments, the plurality of helical blades can be pretreated with nitride to improve hardness and create a more durable bidirectional stabilizer.

FIG. 7 shows a downhole drill string in the wellbore according to one or more embodiments.

The downhole drill string can have at least one bidirectional stabilizer 10*a*, which can be mounted between a bottom hole assembly 304 and a first drill pipe segment 300.

In this embodiment, the downhole drill string is shown with an additional bidirectional stabilizer 10*b*, which can be mounted between the first drill pipe segment 300 and a second drill pipe segment 302.

The downhole drill string is shown in the wellbore surrounding a formation 305.

In embodiments, the bidirectional stabilizer can be a 60 inch long bidirectional stabilizer, a 15 inch long bidirectional stabilizer, or a 20 inch long bidirectional stabilizer. When the bidirectional stabilizer is of a short length, the bidirectional stabilizer can be installed every 100 feet of drill pipe. When such short versions of the bidirectional stabilizer are used, from 3 bidirectional stabilizers to 20 bidirectional stabilizers can be used, and a few can even be stacked through the bottom hole assembly.

With a slightly larger outer diameter, the formation can rub on the bidirectional stabilizer and not on the drill pipe.

In long wells, ranging from 1 mile to 20 miles in length, the bidirectional stabilizer can simultaneously perform as a sacrificial node while centralizing the drill string and protecting the more expensive drill pipe.

Figure 8:
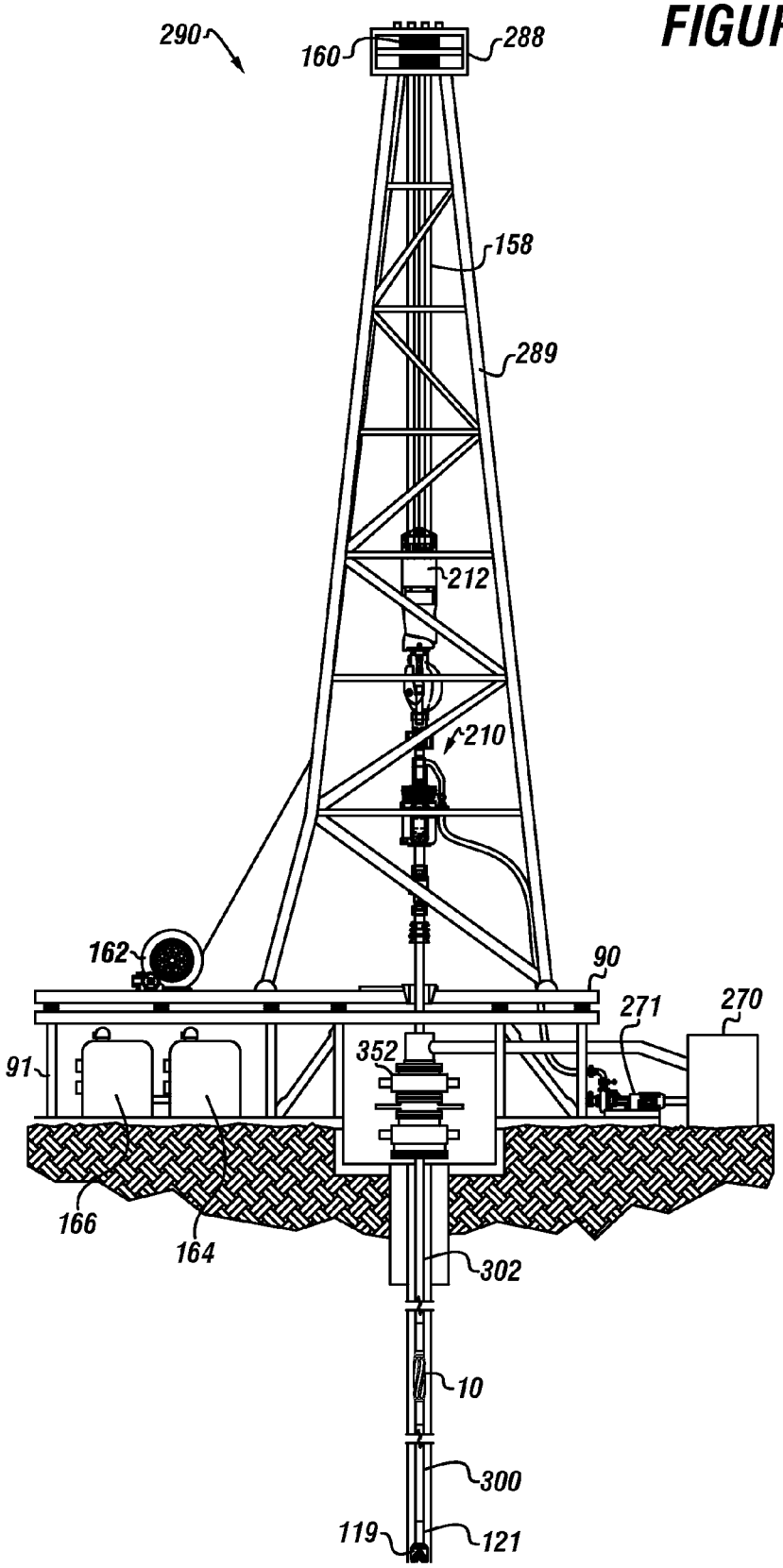
FIG. 8 depicts a drilling rig with the bidirectional stabilizer according to one or more embodiments.

FIG. 8 shows a drilling rig with the bidirectional stabilizer according to one or more embodiments.

The bidirectional stabilizer can be configured to simultaneously smooth a wellbore, centralize the downhole components from wear and damage and flow drilling fluid to at least one downhole component or at least one operating component while allowing wellbore fluid to flow to a surface unimpeded.

The drilling rig 290 can have a tower 289 and a crown 288 with a plurality of sheaves 160. In embodiments, the tower can be a derrick.

The tower can have a rig floor 90 and a rig floor substructure 91.

The drilling rig 290 can have a drawworks 162 connected with a drawworks motor 164 connected to a power supply 166.

A cable 158 can extend from the drawworks 162 through the plurality of sheaves 160 over the crown 288. A lifting block 212 can be connected to the cable 158.

A hydraulic pump 271 can be fluidly connected to a tank 270 for flowing fluid into the wellbore as drill pipe is turned into the wellbore.

A rotating means 210 can be used for turning drill pipe into the wellbore. The rotating means 210 is depicted as either a top drive or a power swivel mounted to the lifting block.

In other embodiments, the rotating means can be a rotary table mounted to the rig floor for rotating drill pipe into a wellbore.

A blowout preventer 352 can be connected between the rotating means and the wellbore for receiving drill pipe.

The bidirectional stabilizer 10 can be mounted between the first drill pipe segment 300 and the second drill pipe segment 302.

A drill bit 119 is shown attached to the first drill pipe segment 300 and a bottom hole assembly 121 is shown connected between the drill bit 119 and the first drill pipe segment 300.

The bidirectional stabilizer can be mounted in drill pipe segments as the drill pipe is run into the wellbore with the drilling rig to save measurement while drilling equipment and bottom hole components downhole.

While these embodiments have been described with emphasis on the embodiments, it should be understood that within the scope of the appended claims, the embodiments might be practiced other than as specifically described herein.

What is claimed is:

1. A bidirectional stabilizer for use in a wellbore, the bidirectional stabilizer comprising:

a) a shaft connected between a first shaft end and a second shaft end, wherein the shaft comprises an outer diameter with the first shaft end and the second shaft end centered around a longitudinal axis;

b) an annulus formed longitudinally through the shaft, wherein the annulus is configured for maximum wellbore fluid flow; and c) a cutting portion formed on an outer surface of the shaft, the cutting portion comprising:

i) a first cutting portion extending at a first angle from the first shaft end;

ii) a second cutting portion extending at a second angle from the second shaft end, the second cutting portion forming a slightly larger outer diameter for the second cutting portion as the second cutting portion extends away from the second shaft end;

iii) a plurality of helical blades longitudinally connected between the first cutting portion and the second cutting portion, each helical blade of the plurality of helical blades having an identical length, each helical blade of the plurality of helical blades existing in a plane parallel to the longitudinal axis, and each helical blade of the plurality of helical blades comprising a smooth blade surface;

iv) a plurality of flutes formed between pairs of helical blades of the plurality of helical blades;

v) a plurality of cutting nodes installed on at least one edge of the first cutting portion, on at least one edge of the second cutting portion, or on at least one edge of the first cutting portion and on at least one edge of the second cutting portion; and vi) a plurality of impact arrestors, each impact arrestor mounted in a location either directly adjacent each cutting node on the first cutting portion, directly adjacent each cutting node on the second cutting portion or in both locations; and wherein the bidirectional stabilizer couples on an end portion to a drill string and on a nose portion to a bottom hole assembly and the bidirectional stabilizer has a symmetrical configuration.

2. The bidirectional stabilizer of claim 1, wherein the end portion and the nose portion range in length from 25 percent to 35 percent of a total length of the bidirectional stabilizer.

3. The bidirectional stabilizer of claim 1, wherein the plurality of impact arrestors comprises at least one of: a tungsten carbide arrestor, a ceramic impact arrestor, a polycrystalline diamond impact arrestor, and a diamond impregnated impact arrestor.

4. The bidirectional stabilizer of claim 1, comprising a plurality of cutting elements, wherein the plurality of cutting elements comprises at least one of: a diamond impregnated cutting element and a polycrystalline diamond cutting element, and wherein the plurality of cutting elements are mounted either directly on a face of the plurality of helical blades or on at least one edge of the plurality of helical blades.

5. The bidirectional stabilizer of claim 1, comprising at least one diamond enhanced hardfacing disposed on least one of: a portion of each helical blade, an entire helical blade, and an area surrounding each impact arrestor.

6. The bidirectional stabilizer of claim 1, comprising from 1 impact arrestor to 60 impact arrestors per bidirectional stabilizer, each impact arrestor configured to simultaneously perform as a shock dampener and as a cutting element.

7. The bidirectional stabilizer of claim 1, wherein each impact arrestor is either flush mounted in the cutting portion or slightly raised above a surface of the cutting portion or the plurality of helical blades and extend from the surface less than the plurality of cutting nodes extend from the surface.

8. The bidirectional stabilizer of claim 1, further comprising a plurality of cutting buttons mounted on at least one of: an edge of each helical blade, cutting portions adjacent the plurality of cutting nodes, and a surface of each helical blade.

9. A drilling rig having a bidirectional stabilizer that also reams into and out of a wellbore, wherein the bidirectional stabilizer is coupled on a first end to a drill string and on a second end to a drill bit, the drilling rig comprising:

a) a tower having a crown with a plurality of sheaves;

b) a drawworks connected to a drawworks motor and connected to a power supply;

c) a cable extending from the drawworks through the plurality of sheaves over the crown;

d) a lifting block connected to the cable;

e) a hydraulic pump connected to a tank for flowing fluid into the wellbore as a drill pipe is turned into the wellbore;

f) a rotating means for turning the drill pipe into the wellbore, the rotating means comprising at least one of: a top drive or a power swivel mounted to the lifting block or a rotary table mounted to a rig floor for rotating the drill pipe into the wellbore;

g) a blowout preventer connected between the rotating means and the wellbore for receiving the drill pipe; and h) the bidirectional stabilizer mounted in drill pipe segments as the drill pipe is run into the wellbore with the drilling rig to save measurement while drilling equipment and bottom hole components downhole, the bidirectional stabilizer comprising:

i) a shaft connected between a first shaft end and a second shaft end, wherein the shaft comprises an outer diameter with the first shaft end and the second shaft end centered around a longitudinal axis;

ii) an annulus formed longitudinally through the shaft, wherein the annulus is configured for maximum wellbore fluid flow; and iii) a cutting portion formed on an outer surface of the shaft, the cutting portion comprising:

1) a first cutting portion extending at a first angle from the first shaft end, the first angle ranging from 10 degrees to 30 degrees from the longitudinal axis forming a slightly larger outer diameter for the first cutting portion as the first cutting portion extends away from the first shaft end;

2) a second cutting portion extending at a second angle from the second shaft end, the second angle ranging from 10 degrees to 30 degrees from the longitudinal axis forming a slightly larger outer diameter for the second cutting portion as the second cutting portion extends away from the second shaft end;

3) a plurality of helical blades longitudinally connected between the first cutting portion and the second cutting portion, each helical blade of the plurality of helical blades having an identical length, each helical blade of the plurality of helical blades existing in a plane parallel to the longitudinal axis, wherein the first cutting portion has a cutting portion length from 5 percent to 35 percent of the length of the plurality of helical blades, the second cutting portion having a cutting portion length from 5 percent to 35 percent of the length of the plurality of helical blades, each helical blade of the plurality of helical blades comprising a smooth blade surface forming a flush fit;

4) a plurality of flutes formed between pairs of helical blades of the plurality of helical blades;

5) a plurality of cutting nodes installed on at least one edge of the first cutting portion, on at least one edge of the second cutting portion, or installed on the at least one edge of the first cutting portion and on the at least one edge of the second cutting portion; and 6) a plurality of impact arrestors, each impact arrestor mounted in a location either directly adjacent each cutting node on the first cutting portion, directly adjacent each cutting node on the second cutting portion or in both locations; and wherein an end portion and a nose portion range in length from 25 percent to 35 percent of a total length of the bidirectional stabilizer, and the bidirectional stabilizer couples on the end portion to the drill string of the drilling rig and on the nose portion to a bottom hole assembly and the bidirectional stabilizer has a symmetrical configuration.

10. The drilling rig of claim 9, wherein the nose portion is connected to the second shaft end for engaging the bottom hole assembly, a tubular or another drill pipe of the drill string, the drill bit, measurement while drilling equipment, rotary steering downhole drilling motors, or combinations thereof.

11. The drilling rig of claim 9, wherein the end portion is connected to the first shaft end comprising a stab end for receiving a stab from the drill string.

12. The drilling rig of claim 9, comprising a plurality of cutting inserts installed on at least one edge of at least one helical blade of the plurality of helical blades forming a flush fit with the at least one edge of the at least one helical blade.

13. The drilling rig of claim 12, wherein a portion of the plurality of cutting inserts are installed adjacent the plurality of cutting nodes at the ends of each of the helical blades of the plurality of helical blades on the first cutting portion, the second cutting portion or both the first cutting portion and the second cutting portion.

14. The drilling rig of claim 9, wherein a plurality of blade mounted impact arrestors have an identical shape and are arranged in either: an alternating configuration on each helical blade or in parallel rows, wherein a first row is offset from a second row on each helical blade.

15. The drilling rig of claim 9, wherein each impact arrestor comprises at least one of: a tungsten carbide arrestor, a ceramic impact arrestor, a polycrystalline diamond impact arrestor, and a diamond impregnated impact arrestor.

16. The drilling rig of claim 9, comprising a plurality of cutting elements comprising at least one of: a diamond impregnated cutting element and a polycrystalline diamond cutting element, and wherein the cutting elements are mounted either directly on a face of the helical blades or directly on at least one edge of the helical blades.

17. The drilling rig of claim 9, comprising at least one diamond enhanced hardfacing disposed on at least one of: a portion of each helical blade, an entire helical blade, and an area surrounding each impact arrestor.

18. The drilling rig of claim 9, comprising from 1 impact arrestor to 60 impact arrestors per bidirectional stabilizer, each impact arrestor configured to simultaneously perform as a shock dampener and as a cutting element.

19. The drilling rig of claim 9, wherein each impact arrestor is either flush mounted in the cutting portion or slightly raised above a surface of the cutting portion or the plurality of helical blades and extending from the surface less than the plurality of cutting nodes extend from the surface.

20. The drilling rig of claim 9, further comprising a plurality of cutting buttons mounted on at least one of: an edge of each helical blade, adjacent cutting nodes, and on a surface of each helical blade.

* * * * *